US007604434B1

(12) United States Patent
Roth

(10) Patent No.: US 7,604,434 B1
(45) Date of Patent: Oct. 20, 2009

(54) APPARATUS FOR LEVELING AND SMOOTHING A SURFACE

(76) Inventor: Thomas L. Roth, 6230 Leroy Pl., Cincinnati, OH (US) 45230

( * ) Notice: Subject to any disclaimer, the term of this patent is extended or adjusted under 35 U.S.C. 154(b) by 318 days.

(21) Appl. No.: 11/247,842

(22) Filed: Oct. 11, 2005

Related U.S. Application Data

(60) Provisional application No. 60/617,823, filed on Oct. 11, 2004.

(51) Int. Cl.
*E01C 19/22* (2006.01)

(52) U.S. Cl. ..... 404/112

(58) Field of Classification Search ..... 404/112, 404/114, 118; 451/353; 15/235.4
See application file for complete search history.

(56) References Cited

U.S. PATENT DOCUMENTS

| | | | | | |
|---|---|---|---|---|---|
| 2,605,683 | A * | 8/1952 | Boulton | 404/112 |
| 2,667,824 | A * | 2/1954 | McCrery | 404/112 |
| 2,689,507 | A | 9/1954 | McCrery | 94/45 |
| 2,865,269 | A * | 12/1958 | McMillan | 404/112 |
| 2,888,863 | A * | 6/1959 | Eisenbeis | 404/112 |
| 2,942,536 | A * | 6/1960 | Irwin | 404/112 |
| 3,259,033 | A * | 7/1966 | Kelley | 404/112 |
| 3,262,377 | A * | 7/1966 | Lursen | 404/112 |
| 3,269,283 | A * | 8/1966 | Grub | 404/112 |
| 3,375,766 | A * | 4/1968 | Zochil | 404/112 |
| 3,412,657 | A * | 11/1968 | Colizza et al. | 404/112 |
| 3,683,761 | A | 8/1972 | Babic | 94/45 |
| 3,791,754 | A * | 2/1974 | Zochil | 404/112 |
| 4,198,178 | A * | 4/1980 | Carlstrom et al. | 404/112 |
| 4,331,297 | A * | 5/1982 | Gipson | 239/289 |
| 4,397,581 | A * | 8/1983 | Jarvis | 404/97 |
| 4,775,306 | A * | 10/1988 | Kikuchi et al. | 425/62 |
| 4,859,115 | A | 8/1989 | Morrison | 404/112 |
| 4,925,341 | A * | 5/1990 | Neal | 404/112 |
| 5,533,830 | A * | 7/1996 | Barichello | 404/96 |
| 6,058,922 | A * | 5/2000 | Sexton | 125/13.01 |
| 6,264,397 | B1 * | 7/2001 | Majewski | 404/112 |
| 6,536,989 | B2 * | 3/2003 | Rijkers | 404/112 |
| 6,648,548 | B2 * | 11/2003 | Kelsay, III | 404/112 |
| 7,018,132 | B2 * | 3/2006 | Ewer et al. | 404/112 |
| 2002/0119005 | A1 * | 8/2002 | Kelsay, III | 404/112 |
| 2004/0018052 | A1 * | 1/2004 | Dhont | 404/112 |

* cited by examiner

*Primary Examiner*—Raymond W Addie
(74) *Attorney, Agent, or Firm*—Mark F. Smith; Smith Brandenburg Ltd

(57) ABSTRACT

An apparatus for leveling and smoothing a surface that permits blades to be easily installed and removed from their corresponding trowel arms. The blades are formed such that attachment of a blade to the trowel arm is achieved by simply attaching the blade using one or more threaded bolts. Further, the blades of the subject invention are formed without the need of riveting or welding operations thereby significantly decreasing the manufacturing time and expense of the blades.

17 Claims, 8 Drawing Sheets

AMENDED
FIG·1
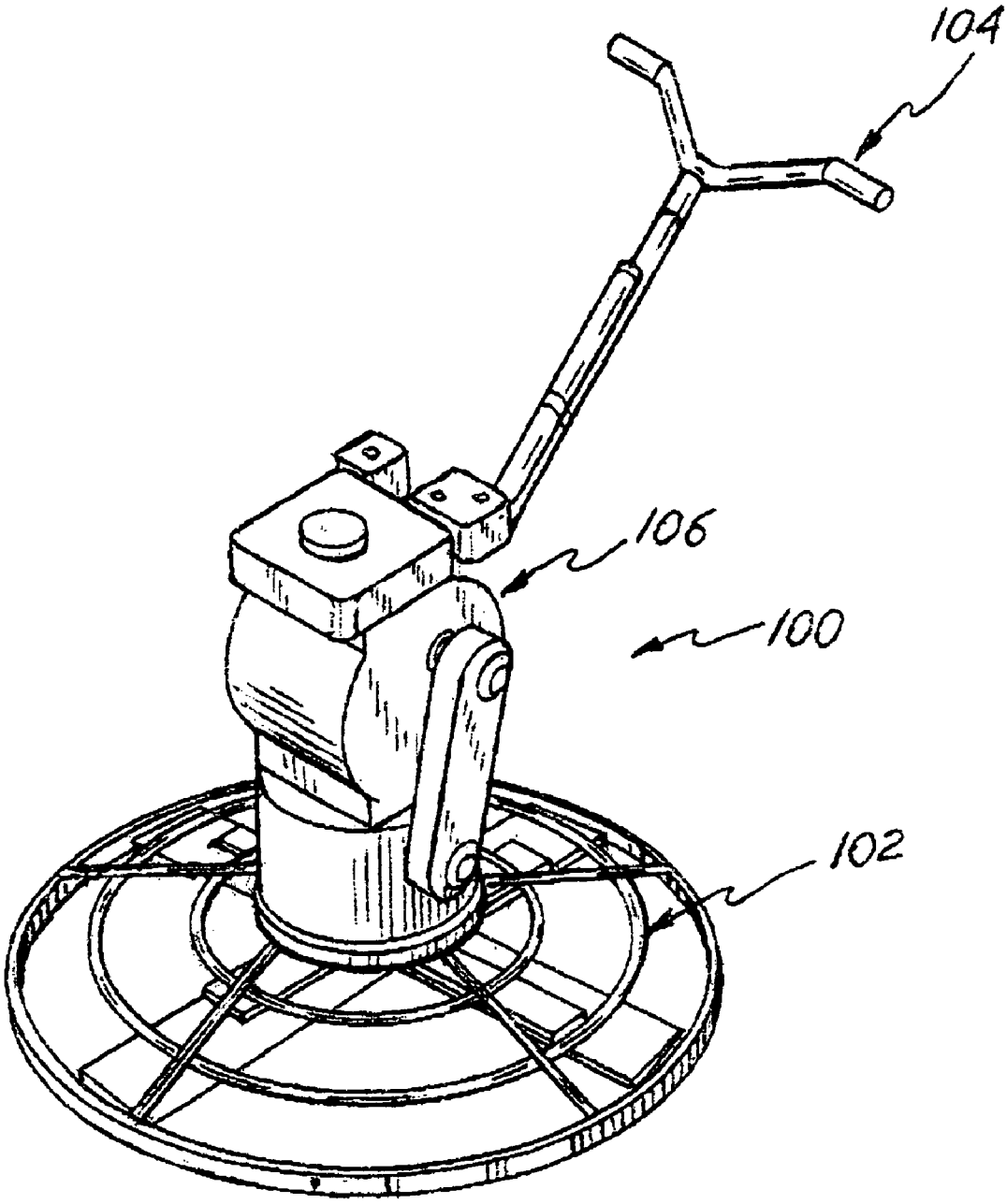

AMENDED
FIG. 15
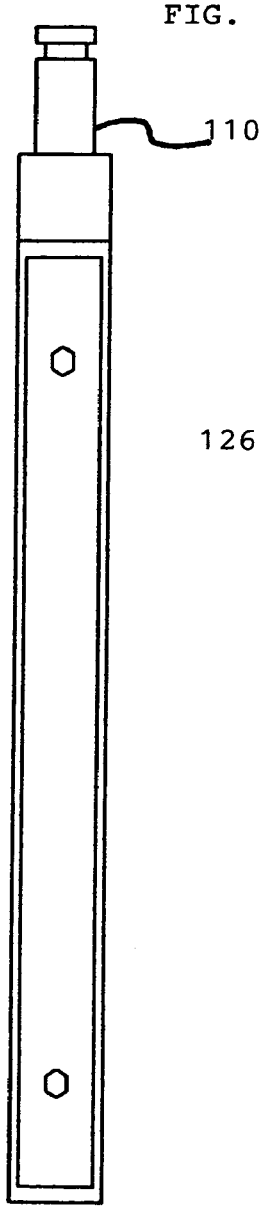
AMENDED
FIG. 16
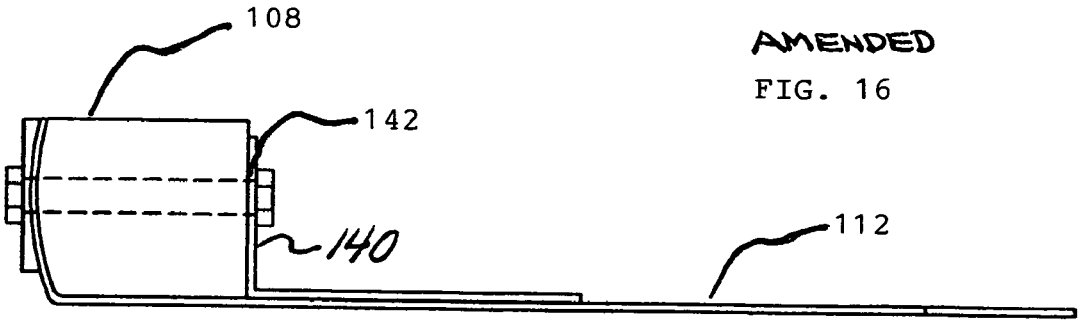

FIG. 17

201
SELECT A BLADE HAVING A DESIRED SIZE AND CONFIGURATION

202
MOUNT BLADE TO A TROWEL ARM SUCH THAT APERATURES FORMED ALONG THE INNER EDGE PORTION OF BLADE ARE ALIGNED WITH THE THREADED HOLES IN THE TROWEL ARM AND PLACE THE BACKING PLATE ALONG THE EDGE OF THE INNER EDGE PORTION

203
INSERT BOLTS THROUGH APERATURES AND THREADED HOLES TO ATTACH BLADE TO THE TROWEL ARM

APPARATUS FOR LEVELING AND SMOOTHING A SURFACE

This application claims benefit of U.S. provisional application for patent Ser. No. 60/617,823 filed Oct. 11, 2004.

BACKGROUND OF THE INVENTION

The present invention is directed to an apparatus for leveling and smoothing a surface and, more particularly, to an apparatus for leveling and smoothing a surface, such as concrete, having a new and improved leveling blade.

A variety of tools have been developed for use in the concrete industry for leveling and smoothing the surface of freshly poured concrete. Such tools include screeds and trowels that vary in form from simply hand-held designs to relatively complex motorized units. Motorized trowels, such as those used in the concrete industry, generally have a blade having a longitudinally extending and centrally positioned backing bar welded or riveted or welded thereon. The backing bar is provided with threaded holes which are aligned with apertures through the trowel arm and adapted for receiving bolts for fastening the backing bar to the trowel arm. A motor is mechanically coupled to the trowel arm to move the blade across the surface of the surface being treated. Accordingly, the blades and attachment assembly are manufactured using multiple steps including stamping, punching, drilling and riveting/welding processes. It should be clear to one skilled in the art that in addition, attachment and removal of the blade from the trowel arm is relatively difficult and time consuming.

It is therefore desirable to have an apparatus for leveling and smoothing concrete having a new and improved blade and method of attaching the blade to the trowel arm. It would also be desirable to have a new and improved method of manufacturing a blade and attaching a blade that is relatively inexpensive to manufacture and permits blades to be relatively easily mounted and secured to the towel arm of a conventional apparatus for leveling and smoothing a surface.

SUMMARY OF THE INVENTION

The current invention is a new and improved apparatus for leveling and smoothing a surface, such as concrete, that is relatively inexpensive to manufacture and permits a blade to be relatively easily mounted and secured thereon.

Specifically, the present invention is an apparatus comprising a frame having a handle and a motor thereon, the motor including an output shaft having radially extending trowel arms mounted thereon. Mounted to each trowel arm is a blade attached to the corresponding trowel arm using a bolts and at least one attachment means for attaching the trowel arm to the output shaft of the motor.

In a preferred embodiment of the invention, the blade is mounted to the corresponding trowel arm using a clamp means.

In a preferred embodiment of the invention, the blade includes a chamfered edge.

In a preferred embodiment of the invention, the blade includes a beveled trailing edge.

In another preferred embodiment of the invention, the apparatus includes a blade stiffener for increasing and/or decreasing the stiffness of the blade.

In a preferred embodiment of the invention, the blade stiffener operates to increase the pressure being exerted along the trailing edge of the blade.

In a preferred embodiment of the invention the blade stiffener is formed in different lengths to increase or decrease the flexibility of the blade.

In a preferred embodiment of the invention the blade stiffener is formed with different materials to increase or decrease the stiffness of the blade stiffener and the corresponding flexibility of the blade.

In a preferred embodiment of the invention the blade stiffener is formed in different thicknesses to increase or decrease the stiffness of the blade stiffener and the corresponding flexibility of the blade.

Another preferred embodiment of the invention is a method of attaching a blade to the trowel arm of an apparatus for leveling and smoothing a surface comprising the steps of selecting a blade having an inner edge portion with spaced apart apertures therein and having the desired size and configuration; mounting the blade to the trowel arm by placing the inner edge portion of the blade in position along the trowel arm such that the spaced apart apertures formed along the inner edge portion are aligned with the threaded holes in the trowel arm; and inserting bolts such that they extend from the inner edge portion through the apertures therein and into the threaded holes of the trowel arm to securely mount the blade to the trowel arm.

In another preferred embodiment of the invention, the method further comprises the steps of: selecting a blade stiffener having a flange portion with spaced apart apertures therein and having the desired flexibility; mounting the blade stiffener to the trowel arm by placing the flange portion in position along the trowel arm such that the spaced apart apertures formed along the flange portion are aligned with the threaded holes in the trowel arm; and inserting bolts such that they extend from the flange portion through the apertures therein and into the threaded holes of the trowel arm to securely mount the blade stiffener to the trowel arm.

Other aspects, advantages and embodiments of the invention will be apparent from the following description and the appended claims.

BRIEF DESCRIPTION OF THE DRAWINGS

To provide a more complete understanding of the present invention and further features and advantages thereof, reference is now made to the following description taken in conjunction with the accompanying drawings, in which:

FIG. 1 is a perspective view of the apparatus for leveling and smoothing a surface of the present invention having a trowel arm and a leveling and smoothing blade mounted thereto;

FIG. 15 is a side view of the mounted blade of FIG. 14;

FIG. 16 is an end view of the mounted blade of FIG. 14;

FIG. 17 is a flow chart showing the steps comprising the method of changing a blade of the apparatus of leveling and smoothing a surface of the subject invention.

DETAILED DESCRIPTION OF THE INVENTION

Figure 3:
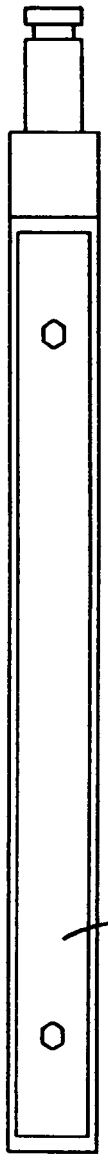
FIG. 3 is a side view of the mounted blade of FIG. 2.
Figure 2:
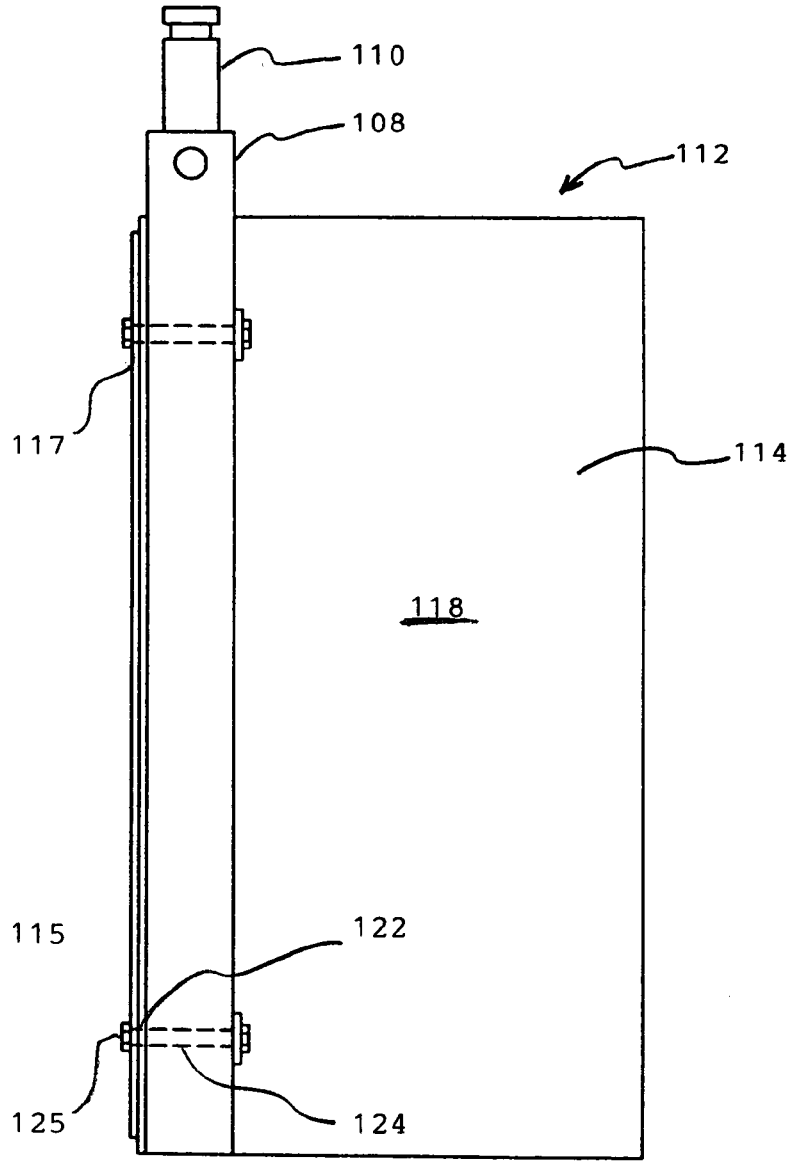
FIG. 2 is a top plan view of the apparatus for leveling and smoothing a surface of FIG. 1 showing the blade mounted to the trowel arm.
Figure 4:
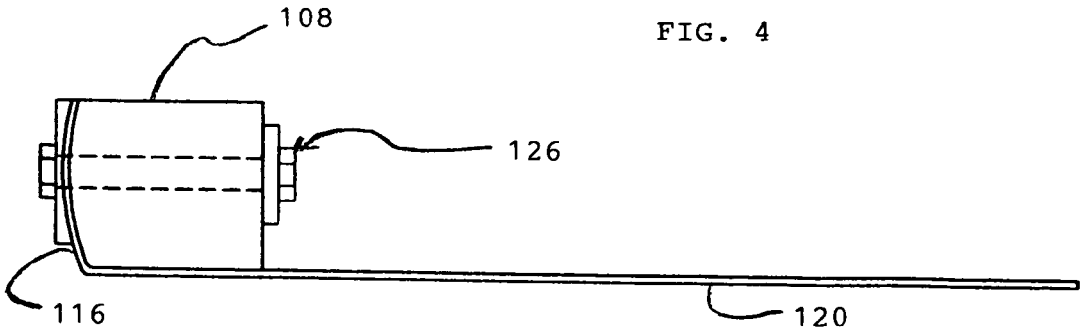
FIG. 4 is an end view of the mounted blade of FIG. 2.

The present invention relates to a new and novel apparatus for leveling and smoothing a surface, such as concrete, and more particularly, to an apparatus for leveling and smoothing a surface having a new and improved leveling blade. In describing the preferred embodiments of the invention, specific terminology will be resorted to for the sake of clarity. However, the invention is not intended to be limited to the specific terms so selected, and it is to be understood that each specific term includes all technical equivalents that operate in a similar manner to accomplish a similar purpose. It should also be understood that the terms "upward" and "upwardly" refer to the direction away from the surface S being leveled or smoothed.

Referring to FIGS. 1 through 4, the apparatus for leveling and smoothing a surface 100, such as concrete, is shown comprising a frame 102 having a handle 104 and a motor with a drive shaft 106 which is mechanically coupled to a radially extending trowel arm 108. As shown, the trowel arm 108 includes a radially extending attachment means 110 for attaching the trowel arm 108 to the drive shaft 106. It should be understood that the attachment means 110 can be any suitable means for attaching trowel arms to the drive shaft of a motorized trowel for leveling and smoothing a surface, such as concrete.

A blade 112 having a generally planar and rectangular shaped portion 114 and an inner edge portion 116 extending upwardly from the planar portion 114. The planar portion 114 includes an upper surface 118 and a lower surface 120 for engaging the surface, such as concrete, cement or the like during operation. In a preferred embodiment of the invention, the inner edge portion 116, as shown, curves upwardly from the planar portion 114. However, it should be understood that the inner edge portion 116 can extend perpendicularly from the planar portion 114. The inner edge portion 116 is provided with spaced apart apertures 122 that are aligned with threaded holes 124 in the trowel arm 108. A backing plate 115 is provided and is placed over the inner edge portion 116 to stiffen and support the inner edge portion 116. As shown, the backing plate 115 is provided with apertures 117 that are spaced to correspond to apertures 122 in the inner edge portion 116. Bolts 126 extend from the inner edge portion 116 through apertures 117 and 122 and are threaded into threaded holes 124 of the trowel arm 108 to mount the blade 112 to the trowel arm 108. It should be understood that preferably the inner edge portion 116 of the blade 112 is directly mounted to the trowel arm 108 by at least one bolt 126, other fastening means, such as a clamp, such as a c-clamp, may also be used.

Figure 6:
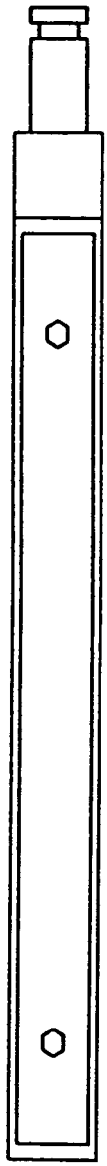
FIG. 6 is a side view of the mounted blade of FIG. 5.
Figure 5:
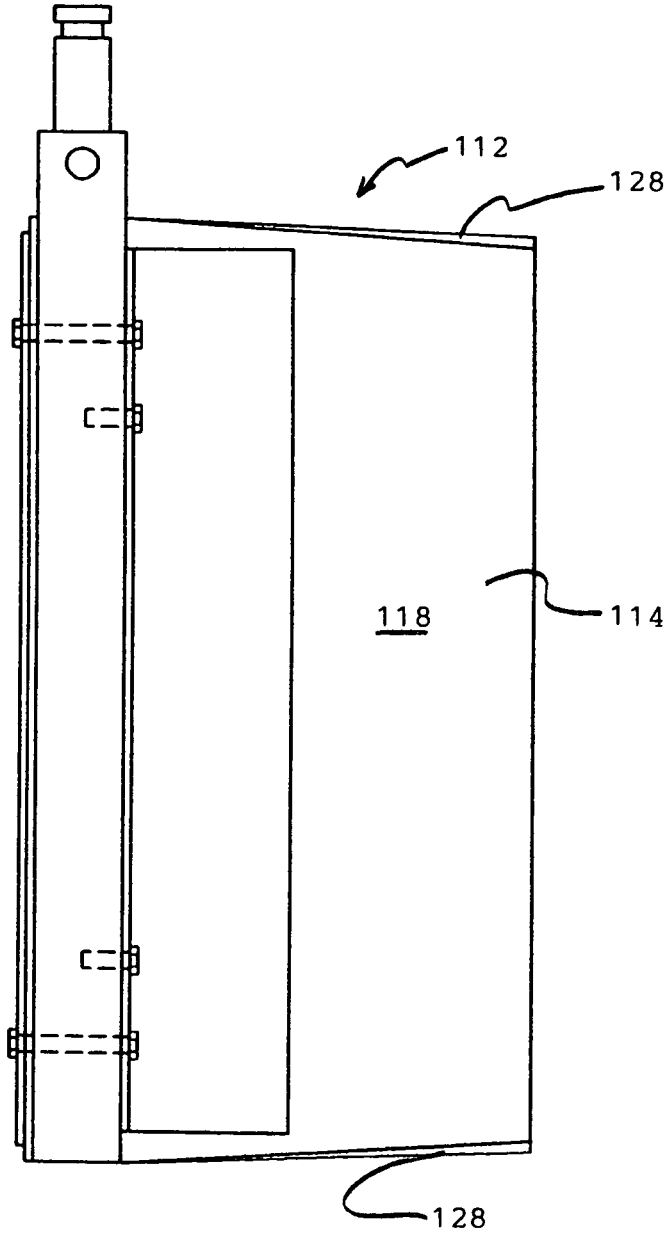
FIG. 5 is a top plan view of another preferred embodiment of the apparatus for leveling and smoothing a surface, showing the blade having beveled edges that are slanted upwardly from the general plane of the blade.
Figure 7:
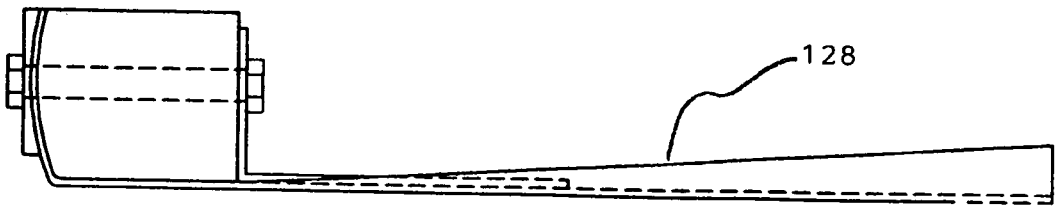
FIG. 7 is an end view of the mounted blade of FIG. 5.

Referring to FIGS. 5 through 7, another preferred embodiment of the invention is shown whereby the blade 112 includes beveled edges 128 that are slanted upwardly from the general planar portion 114 towards the upper surface 118. During operation the beveled edges 128 help to prevent the blade 112 from gouging the surface and improves blade's ability to level and smooth the surface being treated by forcing any particle matter, such as stones, down into the soft surface, such as into the concrete being smoothed.

Figure 9:
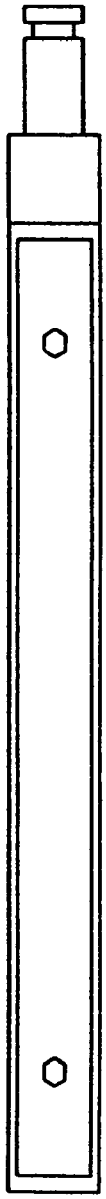
FIG. 9 is a side view of the mounted blade of FIG. 8.
Figure 8:
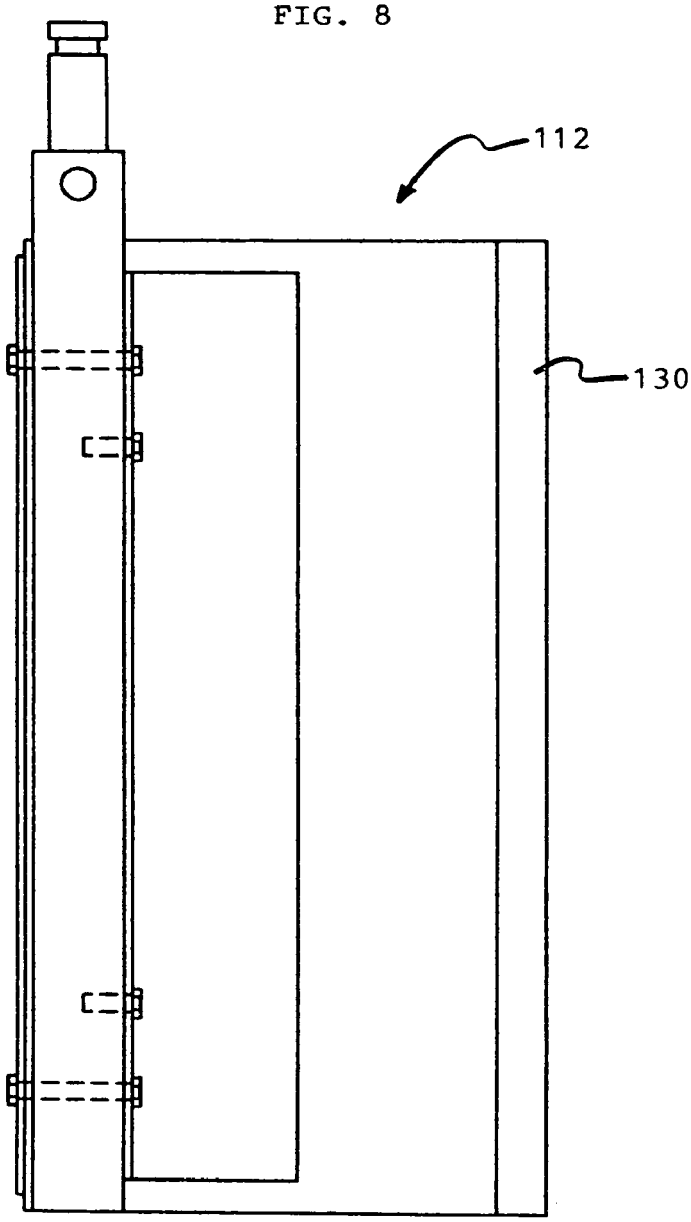
FIG. 8 is a top plan view of another preferred embodiment of the apparatus for leveling and smoothing a surface, showing the blade having an upwardly slanted trailing edge.
Figure 10:
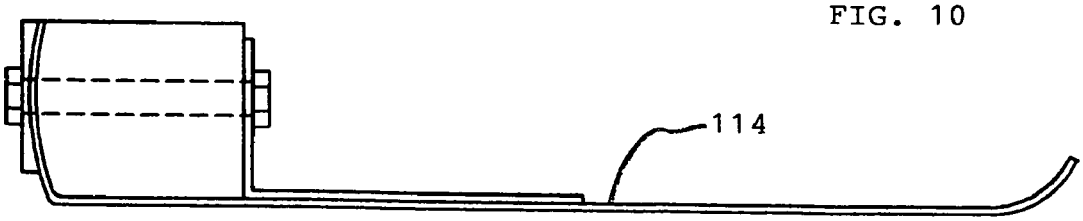
FIG. 10 is an end view of the mounted blade of FIG. 8.

Referring to FIGS. 8 through 10, another preferred embodiment of the invention is shown whereby the trailing edge 130 of the blade 112 is slanted upwardly from the general planar portion 114. During operation the slanted trailing edge 130 improves blade's ability to prevent gouging of the surface being treated and the blade's ability to level and smooth the surface.

Figure 12:
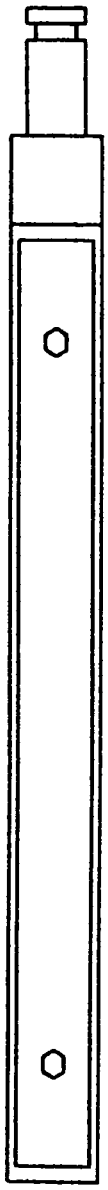
FIG. 12 is a side view of the mounted blade of FIG. 11.
Figure 11:
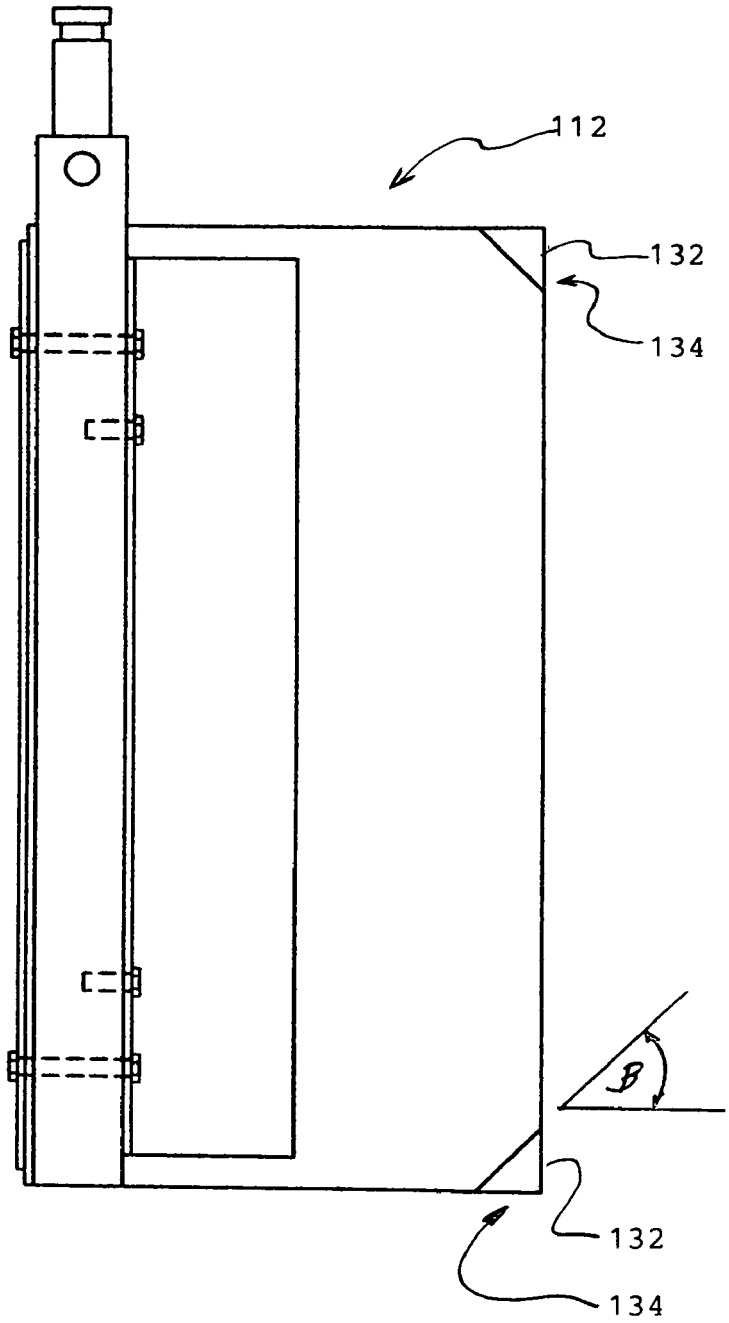
FIG. 11 is a top plan view of another embodiment of the apparatus for leveling and smoothing a surface of the present invention showing the blade having at least one chamfered corner.
Figure 13:
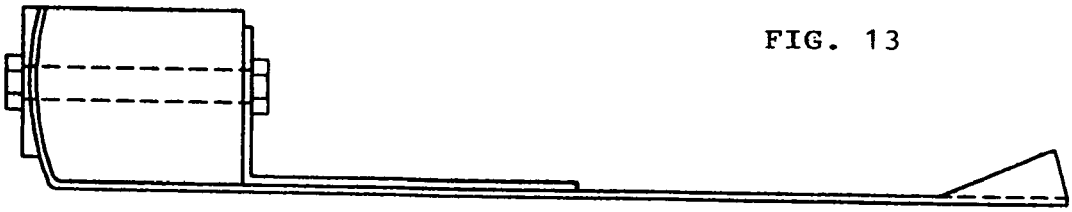
FIG. 13 is an end view of the mounted blade of FIG. 11.

Referring to FIGS. 11 through 13, the corners 132 of the blade 112 includes at least one chamfered corner 134 to improve blade's ability to minimize the formation of ridges in the surface being treated during operation. Preferably the chamfered corners 134 are cut to form about a 45 degree angle β, as shown, but it should be understood that the angle β could be less than or greater than 45 degrees. It should also now be apparent that the corners 134 may also be rounded, such as shown in FIGS. 14 through 16, thereby eliminating the corners and reducing the likelihood of ridges being formed in the surface being smoothed.

Figure 14:
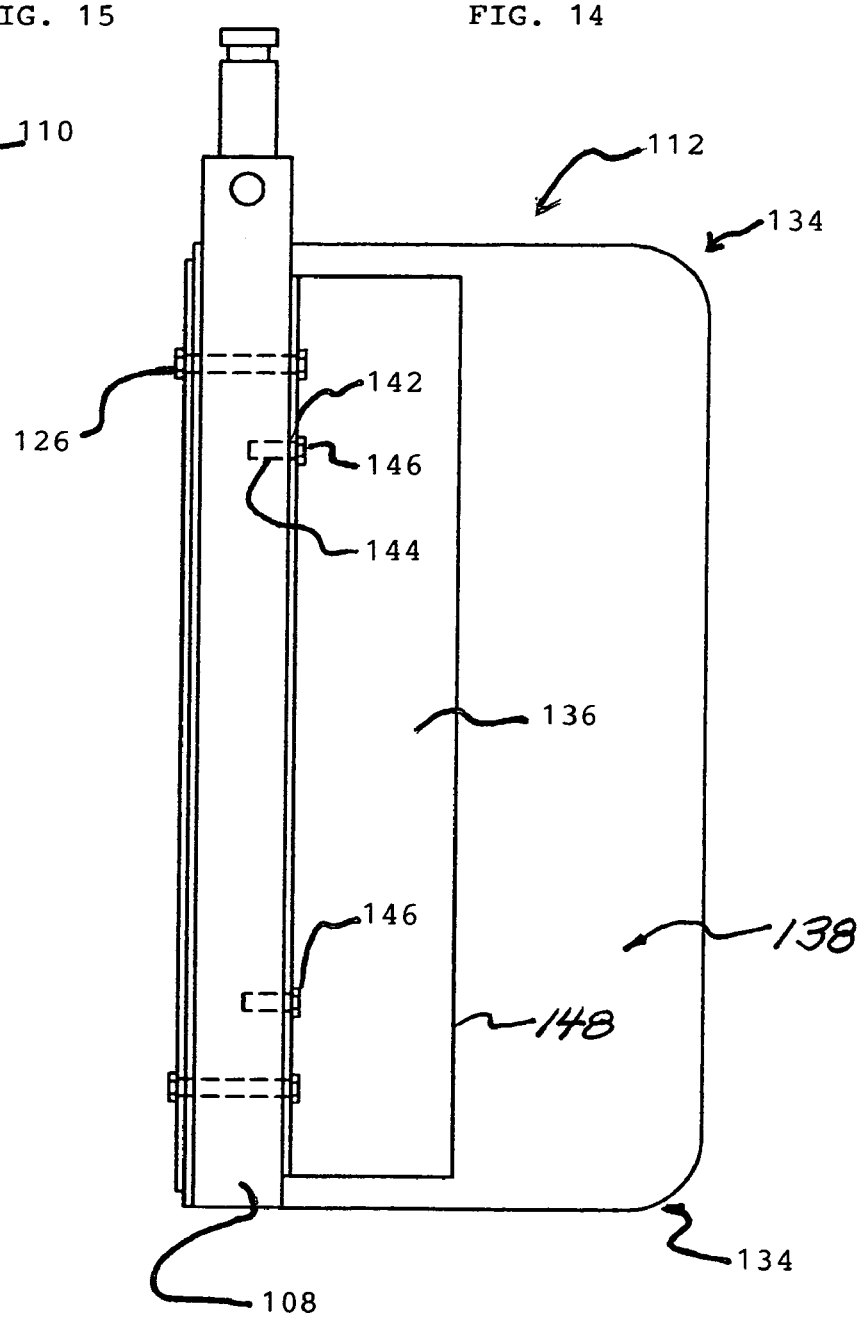
FIG. 14 is a top plan view of another embodiment of the apparatus for leveling and smoothing a surface of the present invention showing the blade having the corners of the trailing edge rounded, FIG. 14 further shows another embodiment of the invention whereby a blade stiffener is mounted to the trowel arm for decreasing the flexability of the blade.

Referring to FIGS. 14 through 16, another preferred embodiment of the invention is shown whereby the apparatus for leveling and smoothing a surface 100 (FIG. 1) further includes a blade stiffener 136 for reducing blade flex during operation. The blade stiffener 136 includes a generally planar portion 138 and a generally perpendicular flange portion 140 having spaced apertures 142 therein that are aligned with threaded holes 144 in the trowel arm 108. Bolts 146 extend from the flange portion 140 through apertures 142 and are threaded into threaded holes 144 of the trowel arm 108 to fasten the blade stiffener 136 to the trowel arm 108. In operation, the blade stiffener 136 provides added stiffness to the blade 112 thereby increasing the pressure along the trailing edge 130 by supporting the weight of the apparatus 100 (FIG. 1) by less surface area of the blade 112.

It should be understood that the blade stiffener 136 may be of different lengths such that its trailing edge 148 extends either closer or farther away from the trailing edge 130 of the blade 112 thereby increasing or decreasing the stiffness of the blade 112, respectively. It should also be understood that the blade stiffener 136 may be formed from various materials having different flexibilities or various thicknesses to increase or decrease the stiffening characteristics of the blade stiffener 136.

The method of attaching a blade to the trowel arm of the apparatus for leveling and smoothing concrete may be carried out in a series of steps as shown in FIG. 17. In the first step 201, a blade is selected having the desired size and configuration. For example, the blade may be a planar blade or it may have includes beveled edges as shown in FIGS. 5 through 7 and described hereinabove, or have a trailing edge that is slanted upwardly from the general plane towards the upper planar portion as shown in FIGS. 8 through 10 and described hereinabove, or have one or more chamfered corners as shown in FIGS. 11 through 13 and described hereinabove, or rounded corners as shown in FIGS. 14 through 16 and described hereinabove. It should be understood that the particular blade characteristics to be used can be easily determined by one skilled in the industry. In the second step 202, the blade is mounted to a trowel arm by placing the inner edge portion of the blade in position along the trowel arm and placing the backing plate against the inner edge portion such that the spaced apart apertures formed along the backing plate and the inner edge portion are aligned with the threaded holes in the trowel arm. In the third step 203, bolts are used such that they extend from the inner edge portion through the apertures therein and are threaded into the threaded holes of the trowel arm to securely mount the blade to the trowel arm. The threaded bolts may be secured in place by threading a nut to the end of the bolt. It should now be apparent that by reversing the steps the blade may be easily and quickly removed and/or replaced by another blade.

Figure 18:
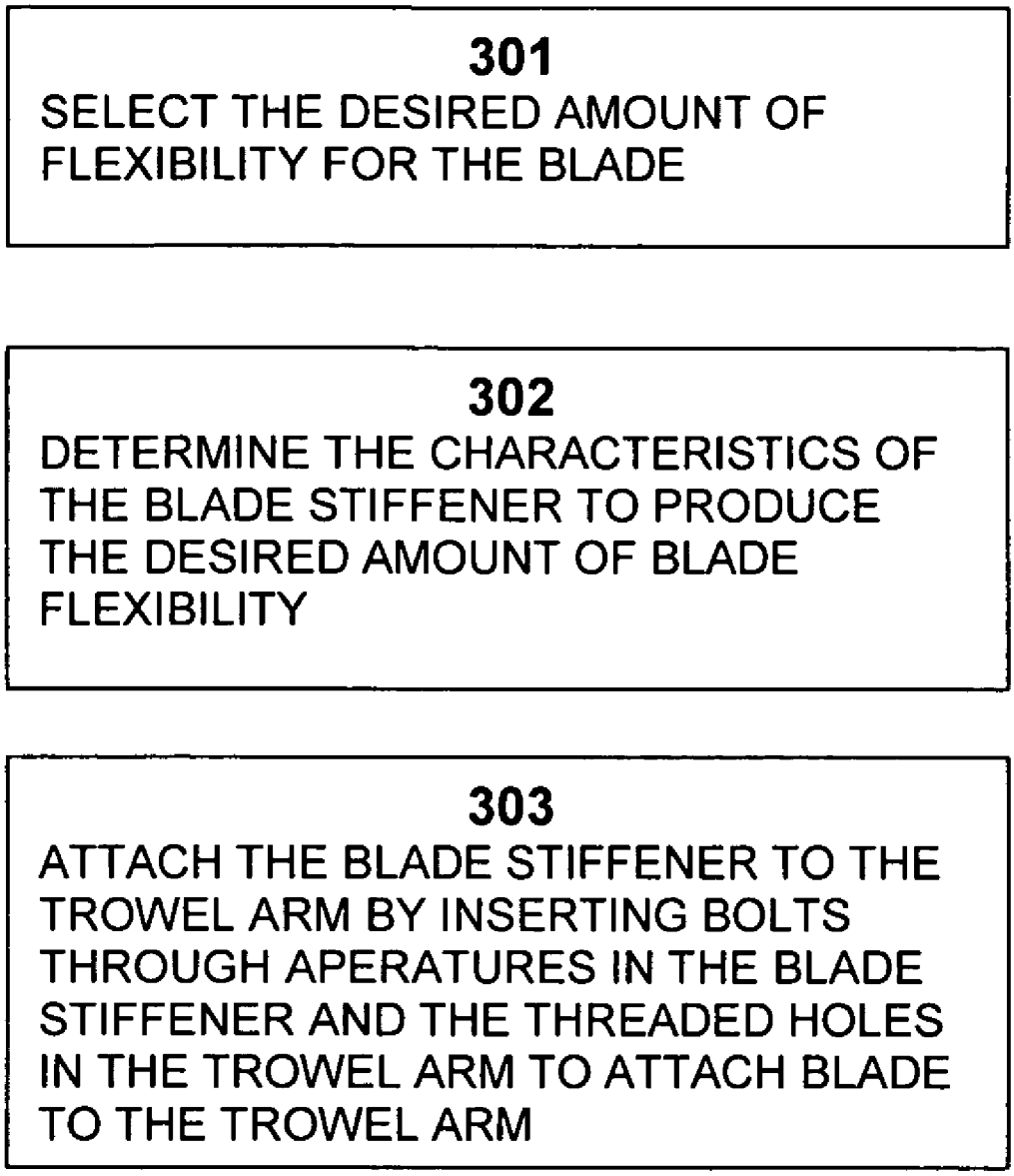
FIG. 18 is a flow chart showing the steps comprising the method of changing the flexibility of the blade of the apparatus of leveling and smoothing a surface of the subject invention.

The method of changing the flexibility of the blade, such as to increase or decrease its flexibility, may also be carried out in a series of steps as shown in FIG. 18. In the first step 301, the desired amount of flexibility is determined. In the second step 302, the characteristics of the blade stiffener is determined and the appropriate blade stiffener is selected. It should be understood that the desired flexibility of the blade and the particular blade stiffener required would be apparent to one skilled in the industry. In the third step 303, the generally perpendicular flange portion of the blade stiffener is positioned along the trowel arm such that spaced apertures therein are aligned with the threaded holes in the trowel arm. Bolts are then inserted such that they extend from the flange portion through the apertures in the flange portion of the blade stiffener and are threaded into threaded holes in the trowel arm to securely fasten the blade stiffener to the trowel arm. It should now be apparent that by reversing the steps the blade stiffener may be easily and quickly removed and/or replaced by another blade stiffener.

It should now be apparent that the apparatus for leveling and smoothing a surface permits blades to be easily installed and removed from their corresponding trowel arms. It should also now be apparent that the blades are formed such that attachment of a blade to the trowel arm is achieved by simply attaching the blade using one or more threaded bolts. Accordingly, the blade and method of attaching the blade to a trowel arm of the present invention does not require the use of a mounting bracket that is welded or riveted onto the upper surface of the blade for use in attaching the blade to a trowel arm. Thus, it should now be apparent that the blades of the subject invention are formed without the need of riveting or welding operations thereby significantly decreasing the manufacturing time and expense of the blades. In addition, it should now be apparent that the flexibility of the blades can be easily adjusted by use of a stiffener that can be easily installed or removed from the apparatus.

Although the foregoing invention has been described in some detail for purposes of clarity of understandings, it will be apparent that certain changes and modifications may be practiced within the scope of the appended claims. Accordingly, it should be understood that the present disclosure is to be considered as exemplary of the principals of the invention and is not intended to limit the invention to the embodiments illustrated and the invention is not to be limited to the details given herein, but may be modified within the scope and equivalents of the appended claims.

What is claimed is:

1. An apparatus for leveling and smoothing a surface comprising a frame having a handle and a motor thereon, the motor including an output shaft having at least one radially extending trowel arms mounted thereon;

mounted to each said trowel arm is a blade having a planar portion, an inner edge portion, and a trailing edge;

wherein said blade is mounted to a corresponding trowel arm such that said inner edge portion of said blade is directed upwardly from said planar portion such that it is substantially perpendicular to said planar portion and is directly attached to the trowel arm.

2. The apparatus of claim 1 wherein said blade is attached to the trowel arm by at least one bolt.

3. The apparatus of claim 1 wherein the apparatus further comprises a backing plate for attaching said blade to the trowel arm.

4. The apparatus of claim 1 further comprises means for attaching the trowel arm to the output shaft of the motor.

5. The apparatus of claim 1 wherein said blade includes a chamfered edge.

6. The apparatus of claim 1 wherein said trailing edge is a beveled trailing edge.

7. The apparatus of claim 1 further comprises a blade stiffener for changing the flexibility of the blade.

8. The apparatus of claim 7 wherein said the blade stiffener operates to adjust the pressure being exerted along said trailing edge of said blade.

9. The apparatus of claim 7 wherein said blade stiffener is formed in different lengths to change the flexibility of the blade.

10. The apparatus of claim 7 wherein said blade stiffener is formed from different materials to change the flexibility of said blade.

11. The apparatus of claim 7 wherein said blade stiffener is formed in different thicknesses to change the flexibility of said blade.

12. A blade for use with an apparatus for leveling and smoothing a surface having at least one trowel arm, said blade comprising:

a planar portion;

an inner edge portion;

a trailing edge;

wherein the entire inner edge portion extends upwardly from said planar portion and includes means for stiffening and supporting said inner edge portion and said inner edge portion further having apertures for cooperating with threaded holes in a trowel arm for receiving a bolt for attaching said blade to the trowel arm.

13. The apparatus of claim 12 wherein said trailing edge is a beveled trailing edge.

14. The apparatus of claim 12 wherein said blade includes a chamfered edge.

15. The apparatus of claim 12 wherein said blade further comprises a removable blade stiffener for changing the flexibility of said blade.

16. A method of attaching a blade to holes in a trowel arm of an apparatus for leveling and smoothing a surface comprising the steps of:

selecting a blade having a trailing edge, a planar portion and an inner edge portion extending upwardly from the planar portion with spaced apart apertures therein such that the apertures extend in a direction substantially parallel to the planar portion;

mounting the blade to the trowel arm by placing the inner edge portion of the blade in position along the trowel arm such that the spaced apart apertures formed along the inner edge portion are aligned with the holes in the trowel arm; and inserting bolts such that they extend from the inner edge portion through the apertures therein and into the holes of the trowel arm to securely mount the blade to the trowel arm.

17. The method of claim 16 further comprising the steps of:

selecting a blade stiffener having a flange portion with spaced apart apertures therein and having the desired flexibility;

mounting the blade stiffener to the trowel arm by placing the flange portion in position along the trowel arm such that the spaced apart apertures formed along the flange portion are aligned with the holes in the trowel arm; and inserting bolts such that they extend from the flange portion through the apertures therein and into the holes of the trowel arm to securely mount the blade stiffener to the trowel arm.

* * * * *